United States Patent [19]

Diaz

[11] 4,249,693

[45] Feb. 10, 1981

[54] CARDBOARD CONTAINER COVER

[76] Inventor: Michael Diaz, 6704 Sycamore #2, New Orleans, La. 70127

[21] Appl. No.: 85,464

[22] Filed: Oct. 17, 1979

[51] Int. Cl.[3] ..... B65D 17/16; B65D 43/04

[52] U.S. Cl. ..... 229/43; 229/7 R; 229/17 R; 206/518

[58] Field of Search ..... 229/7 R, 17, 44, 43; 206/518

[56] References Cited

U.S. PATENT DOCUMENTS

| | | | |
|---|---|---|---|
| 1,240,563 | 9/1917 | Griffith et al. | 229/17 R |
| 1,767,742 | 6/1930 | Case | 229/44 R X |
| 2,282,150 | 5/1942 | Amdary | 229/7 R |
| 2,770,403 | 11/1956 | Eckley | 229/7 R X |
| 2,781,156 | 2/1957 | Wallo | 229/7 R X |
| 2,805,812 | 9/1957 | Seaton | 229/43 |
| 3,180,552 | 4/1965 | Atkinson | 229/7 R |
| 3,265,282 | 8/1966 | Maxwell | 229/7 R |
| 3,615,039 | 10/1971 | Ward | 206/518 |
| 3,695,504 | 10/1977 | Simpson | 229/7 R |
| 3,733,022 | 5/1973 | Kapiloff | 229/7 R |

*Primary Examiner*—Davis T. Moorhead
*Attorney, Agent, or Firm*—Keaty & Garvey

[57] ABSTRACT

A dispensing cup-box closure apparatus provides a pair of rectangular planar members joining at a common edge, each of the members having uniform widths corresponding to the width of the common edge. The planar members form an angle with respect to each other of substantially 90°. A pair of correspondingly sized side webb members are provided, each having at least three edges and each side webb member being integrally connected respectively along at least two of the edges to the pair of planar members. The integral connection of the correspondingly sized side webb members and the planar rectangular members provide a container having an inner container space and an opening for receiving a dispensed product into the inner container space. The integral container provides a diagonally cut cube which conveniently covers and seals the dispensing flap opening of conventional rectangular cardboard boxes in addition to the container function.

7 Claims, 4 Drawing Figures

CARDBOARD CONTAINER COVER

BACKGROUND OF THE INVENTION

1. Field of the Invention

The present invention relates to dispensing containers and more particularly relates to dispensing containers which form closures on sealed cardboard box type containers of particulate granular material especially after the cardboard container is opened.

2. General Background and Prior Art

In the packaging industry, there is provided for a number of especially granular or particulate products a cardboard box type container, which is generally rectangular in configuration having a sealed dispensing opening at the top which seal is normally opened by ripping a portion of the cardboard box itself along for example, a serrated opening line.

Many such products are granular in nature, and are easily stored and dispensed through such inexpensive throw away type cardboard containers. Exemplary of such materials which might be found in dispensing cardboard containers are cereal, detergents, coffee, sugar, flour, salt, and the like. Generally the dispensing product is dispensed into cooking or eating receptacles and the like once the flap closure is opened.

A problem exists with such cardboard box type containers in that there is generally required a means for resealing the container once the actual container has been ruptured at the preestablished serrations or like points on the box where dispensing will take place.

This becomes a problem not only for spoilage of the goods because of exposure to the air, moisture, and the like, but also provides a problem when trying to transport such boxes in automobiles, for example. As an example, a box of soap powder must be carried to and from the washing machines, or in a car to a laundromat and frequently can be knocked on its side dispensing undesirably the contents over the seats and floor of the automobile.

A further problem is seen in the dispensing of commodities which are granular or particulate in nature from cardboard boxes. The containers are usually opaque and it is often difficult if not impossible to determine how much is being dispensed until too much is often emptied from the box onto the desirable utensil. Indeed, it is commonplace for housewives or like such persons to open a box of detergent and thereafter keep a cup measure or such container in the soap box or on top of it in order to properly measure the contents before use.

It would be desirable to provide a container which would provide the dispensing function of common cup measuring containers while at the same time assisting in the formation of a closure over the dispensing opening of the cardboard box once the initial opening was made.

3. General Discussion of the Present Invention

The present invention solves these prior art problems and shortcomings in a simple and inexpensive manner by providing a dispensing cup and box closure apparatus which comprises a pair of rectangular planar members preferably of identical size joining at a common edge, each of the members having uniform widths corresponding to the widths of the common edge and the edges forming an angle with respect to each other of substantially ninety degrees (90°).

Attached integrally to the pair of corresponding rectangular planar members is a pair of correspondingly sized side webb members, each having at least three edges (a triangular shape preferred) and each side webb member integrally connecting at least two of said edges to the pair of planar members with an integral connection being formed by each of the side members respectively with each of the planar rectangularly members thus providing a container having an inner container space and an opening for receiving a dispensed product into the container space.

In the preferred embodiment the container forms a diagonally cut half cube which neatly fits onto the corner of a cardboard box over the dispensing opening which has been torn therein.

If desired, indicia can be provided to the apparatus for measuring volumes of granular particulate material such as cereal, soap, salt, flour or the like.

Thus, it is an object of the present invention to provide a dispensing cup-box closure apparatus which forms a closure over the sealed cardboard box dispensing opening to which it is attached after it has been opened by the consumer.

It is another object of the present invention to provide a dispensing cup-box closure apparatus which is provided with a biasing means for enhanced attaching of the closure apparatus of to a conventional cardboard box at the dispensing opening.

Still a further object of the present invention is to provide a cup-box closure apparatus which also forms an integral container capable of carrying granular or particulate materials therein.

Still another object of the present invention is to provide a dispensing cup-box closure apparatus which is simple and easy to manufacture and easy to use.

It is another object of the present invention to provide a dispensing cup-box closure apparatus which can be readily used with existing cardboard boxes.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
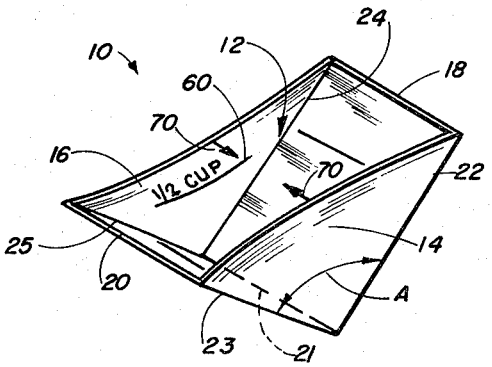
FIG. 1 is a perspective view of the preferred embodiment of the apparatus of the present invention.
Figure 2:
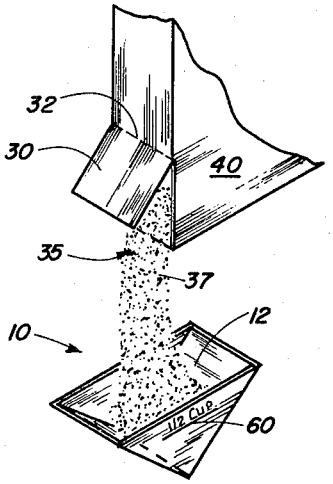
FIG. 2 is a perspective view of the preferred embodiment of the apparatus of the present invention illustrating the dispensing of a granular particulate material thereinto from a conventional cardboard box flap opening.

FIGS. 1 and 2 best illustrate the preferred embodiment of the apparatus of the present invention designated generally by the numeral 10.

In FIG. 1 there can be seen closure 10 which comprises generally a pair of rectangular planar members 18, 20 which are preferably identically sized joining at a common edge 21 with an angle "A" of approximately 90° being formed between the planar surfaces of each rectangular planar member in the preferred embodiment.

Figure 3:
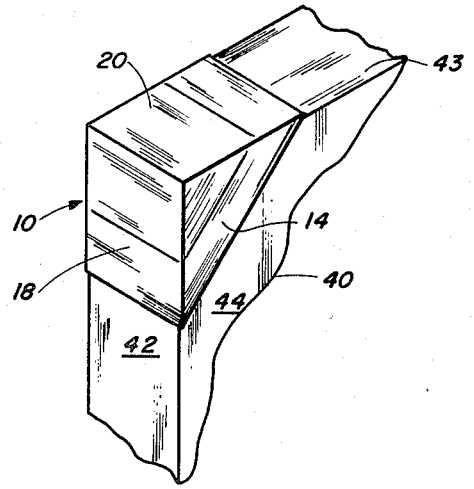
FIG. 3 is a perspective view of the preferred embodiment of the apparatus of the present invention as forming a closure over a conventional cardboard box flap type dispensing opening.

It should be understood that this ninety degree (90°) or right angle configuration allows easy attachment of closure 10 to a conventional cardboard box 40 as best shown in FIG. 3.

Integrally attached to planar members 18, 20 is a pair of corresponding (preferably triangularly shaped) side webb members 14, 16. Each webb member is integrally connected along at least two edges to the pair of planar members 18, 20. Note in FIG. 1 that edge 24 and edge 25 form integral connections between webb member 16 and planar members 18, 20 respectively.

In a like manner, side webb member 14 provides at edge 22 and edge 23 respectively integral connection with coplanar members 18, 20.

The overall configuration of closure 10 thus taught and shown in FIG. 1 forms generally a diagonally cut cube which easily conforms to a corner of a conventional cardboard box 40 forming a closure over the flap closure 30 portion thereof so as to close the dispensing opening 35.

Note from an inspection of FIG. 2, that closure 10 provides an inner space 12 which is adapted to receive a dispensed product 37 thereinto. In FIG. 2 container-closure 10 is shown receiving a granular material 37 thereinto which could be for example any of a number of particulate or granular commodities such as cereal, soap, salt, rice, flour, and the like.

In FIG. 2 there can also be seen indicia 60 which provides suitable measures for volume so as to properly guage the amount of contents being added to inner space 12 of container-closure 10.

Figure 4:
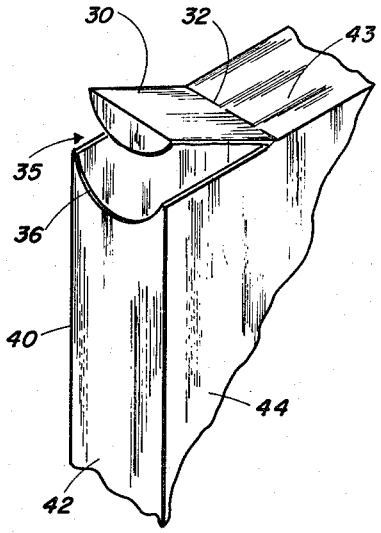
FIG. 4 is a partial perspective view of a conventional cardboard box illustrating the box flap closure and dispensing openings portions thereof.

In FIGS. 2, 3 and 4 there is seen partially a conventional cardboard box 40 which is provided with box panels 44 which can be for example front and rear panels to cardboard box 40 as well as side panels 42 and top panels 43. In FIG. 2 and in FIG. 3 there can be best be seen a flap closure 30 which hingedly attaches at hinge 32 to top panel 43. Flap closure 30 when peeled open, provides a dispensing opening 35. Normally, a serrated edge 36 is provided at dispensing opening 35 which can easily be punctured by the consumers so as to provide the opening for dispensing as shown best in FIG. 4.

FIG. 3 shows container-closure member 10 attached in its normal operating position on box 40. Note that planar members 18, 20 mount respectively upon side and top panels 42, 43 of box 40. Side webb members 14, 16 conform to the front and rear box panels with side webb member 14 shown in FIG. 3 as abutting front panel 44 in a face-to-face relationship. The one half diagonal cube configuration to container closure 10 allows for a fit over the dispensing opening 35 at that corner of cardboard box 40 adjacent opening 35. The integral connections of the coplanar members 18, 20 and side webb members 14, 16 form the desirable integral closure and inner space 12 which allows container closure 10 to receive a dispensed product 37 thereinto.

If desired, side webb members 14, 16 could be inwardly biased (see arrows 70 FIG. 1) so as to form a biasing effect to container closure 10 which would enhance its gripping upon cardboard box 40.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A removable dispensing container-box closure apparatus comprising:

a. a pair of rectangular planar members joining at a common edge, each of said members having uniformed widths corresponding to the width of said common edge, said planar members forming an angle with respect to each other of substantially ninety degrees (90°); and b. a pair of corresponding side webb members each having at least three edges and each side webb member integrally connecting at at least two of said edges to said pair of planar members, the integral connection of said side webb members and said planar rectangular members providing a container having an inner container space and providing an opening for receiving a dispensed product into said inner container space, said webb members being inwardly biased toward each other to provide gripping means for attaching said apparatus to a box to be covered, said apparatus being freely removable from any product dispensing box with which it is being used.

2. The apparatus of claim 1 wherein said webb members are each triangularly shaped.

3. The apparatus of claim 1 wherein said planar members are rectangular.

4. The apparatus of claim 3 wherein said planar members are of identical size.

5. The apparatus of claim 1 wherein said planar members and said side webb members are plastic.

6. The apparatus of claim 5 wherein said webb members are biased inwardly and are of a plastic material having a memory.

7. The apparatus of claim 1 wherein said webb members are biased inwardly and are of a plastic material having a memory.

* * * * *